US006253658B1

(12) United States Patent
Kimura

(10) Patent No.: US 6,253,658 B1
(45) Date of Patent: Jul. 3, 2001

(54) HYDRAULIC CONTROL SYSTEM

(75) Inventor: Jun Kimura, Kani-gun (JP)

(73) Assignee: Kayaba Industry Co., Ltd., Tokyo (JP)

( * ) Notice: Subject to any disclaimer, the term of this patent is extended or adjusted under 35 U.S.C. 154(b) by 0 days.

(21) Appl. No.: 09/447,968

(22) Filed: Nov. 23, 1999

(51) Int. Cl.[7] ..... F15B 11/08; F15B 13/04
(52) U.S. Cl. ..... 91/447; 91/450; 91/461
(58) Field of Search ..... 91/447, 449, 450, 91/451, 452, 461

(56) References Cited

U.S. PATENT DOCUMENTS 4,417,502 * 11/1983 Shore ..... 91/447
4,955,283 * 9/1990 Hidaka et al. ..... 91/447
5,048,395 * 9/1991 Ohshima ..... 91/447
5,207,059 * 5/1993 Schnexnayder ..... 91/461 X
5,752,426 * 5/1998 Ikei et al. ..... 91/447
6,026,730 * 2/2000 Yoshida et al. ..... 91/447

* cited by examiner

*Primary Examiner*—John E. Ryznic
(74) *Attorney, Agent, or Firm*—Steinberg & Raskin, P.C.

(57) ABSTRACT

The invention provides a hydraulic control system capable of preventing an objective from crashing even if a load supporting passage is fractured or the like during a crane operation for moving down the objective with a hydraulic shovel. When a pilot pressure for switching a control valve 2 to a downward position b is less than a predetermined value, only first selector means switches, and when the pilot pressure exceeds the predetermined value, second selector means as well as the first selector means switches.

5 Claims, 11 Drawing Sheets

Fig.11 *Prior Art*
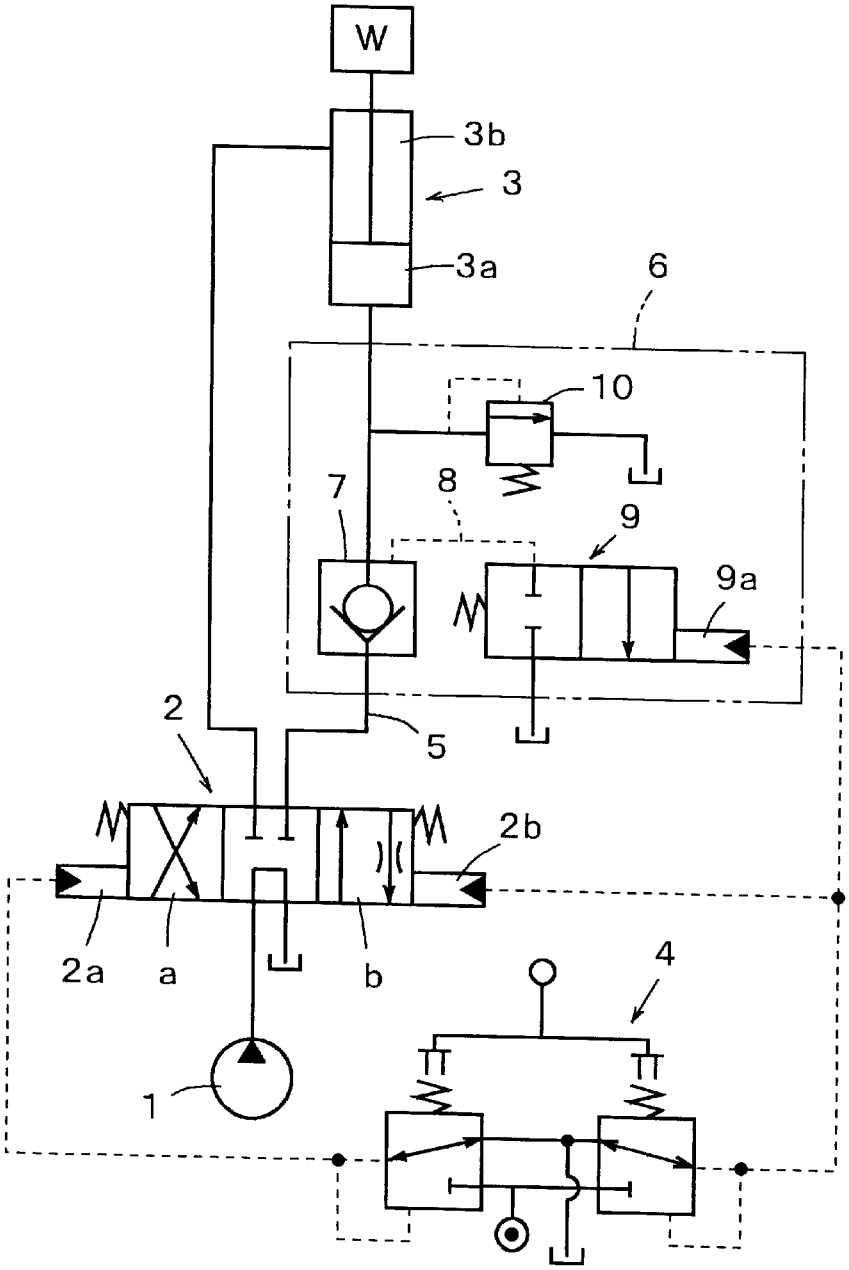

HYDRAULIC CONTROL SYSTEM

BACKGROUND OF THE INVENTION

1. Field of the Invention

This invention relates to a hydraulic control system for controlling a hydraulic operation machine such as a hydraulic shovel.

2. Description of Related Art

FIG. 11 shows a conventional hydraulic control system, which is for controlling a hydraulic operation machine such as a hydraulic shovel.

Pump 1 is connected with a cylinder device 3 via a control valve 2.

The control valve 2 switches by a pilot pressure introduced into a pilot chamber 2*a* or 2*b*. The pilot pressure to be introduced into the pilot chambers 2*a* and 2*b* is controlled by a pilot valve 4. For example, if the pilot pressure is introduced into the pilot chamber 2*a*, the control valve 2 switches to an upward position a (the left side of the drawing) in proportion to the volume of the introduced pilot pressure. If the pilot pressure is introduced into the pilot chamber 2*b*, the control valve 2 switches to a downward position b (the right side of the drawing) in proportion to the volume of the introduced pilot pressure.

Between the control valve 2 and a bottom pressure chamber 3*a* of the cylinder device 3, a load supporting valve assembly 6 is arranged, and which includes a pilot check valve 7, a selector valve 9 and an overload relief valve 10.

As discussed in more detail further below, the control valve 2 is connected to a load supporting passage 5, and the pilot check valve 7 is provided on the load supporting passage 5.

The pilot check valve 7 passes flow only from the control valve 2. A check function of the pilot check valve 7 is released in communication between a pilot passage 8 and a tank.

The pilot passage 8 of the pilot check valve 7 is connected to the selector valve 9.

The selector valve 9 in a normal state shown in FIG. 11 is in a blocking position for closing the pilot passage 8. The pilot check valve 7, therefore, causes its normal check function to be active. Whereas, on introduction of the pilot pressure into a pilot chamber 9*a*, the selector valve 9 switches to a communicating position so as to link the pilot passage 8 with the tank, thus the check function of the pilot check valve 7 is released.

The pilot pressure in the pilot chamber 2*b* of the control valve 2 is introduced into the pilot chamber 9*a* of the selector valve 9 designed as mentioned above. That is to say, the selector valve 9 is adapted to switch to the communicating position whenever the control valve 2 switches to the downward position b (the right side of the drawing).

The overload relief valve 10 is connected to a passage between the pilot check valve 7 and the bottom pressure chamber 3*a* of the cylinder device 3. In a maintaining state of work load W. the overload relief valve 10 functions to prevent an extraordinary increase of a load pressure in the bottom pressure chamber 3*a*, thereby absorbing shock produced when an external force is applied to the work load W.

Operation of the conventional hydraulic control system will be explained below.

As shown in FIG. 11, if the control valve 2 is in a neutral position, oil discharged from the pump 1 is introduced into neither the bottom pressure chamber 3*a* nor a rod-side pressure chamber 3*b* of the cylinder device 3.

The pilot pressure is not also introduced into the pilot chamber 9*a*, and the selector valve 9 is in the blocking position, so that the check function of the pilot check valve 7 is inactive. Thus, the flow from the bottom pressure chamber 3*a* of the cylinder device 3 is blocked and the work load W is assuredly maintained.

When the work load W needs to move up, the pilot pressure is introduced from the pilot valve 4 into the pilot chamber 2*a*, so that the control valve 2 switches to the upward position a (the left side of the drawing).

In this time, since the selector valve 9 keeps in the blocking position, the check function of the pilot check valve 7 is active. Hence, when the discharge pressure of the pump 1 is properly increased, the oil discharged from the pump 1 opens the pilot check valve 7 and then is introduced toward the bottom pressure chamber 3*a* of the cylinder device 3, while the hydraulic fluid in the rod-side pressure chamber 3*b* is discharged to the tank, thus moving up the work load W.

On the other hand, when the work load W needs to move down, the pilot pressure is introduced from the pilot valve 4 into the pilot chamber 2*b*, so that the control valve 2 switches to the downward position b (the right side of the drawing).

In this time, the pilot pressure is also introduced into the pilot chamber 9*a*, and the selector valve 9 switches to the communication position, so that the check function of the pilot check valve 7 is inactive. Hence, the hydraulic fluid in the bottom pressure chamber 3*a* of the cylinder device 3 passes through the pilot check valve 7 and is discharged into the tank in accordance with the degree of opening control valve 2, thus moving down the work load W.

Regarding the hydraulic control systems of prior art, in an operation for moving an objective downward with a hydraulic shovel in a craning work, for example, if the load supporting passage 5 is fractured, the hydraulic fluid in the bottom pressure chamber 3*a* of the cylinder device 3 may rapidly escape from the fractured section, whereby causing the objective to rapidly fall.

In this case, by returning the position of the control valve 2 to the neutral position, the selector valve 9 switches back to the blocking position, so that the check function of the pilot check valve 7 becomes active, whereby the falling objective can be stopped.

Actually, however, the objective must crashes on the ground due to its falling speed before the control valve 2 switches to the neutral position.

In the hydraulic control system of prior art, in order to absorb shock produced when the external force is applied to the work load W, in the supporting state of the work load W, the overload relief valve 10 must be connected to the passage between the bottom pressure chamber 3*a* of the cylinder device 3 and the pilot check valve 7.

The load supporting valve assembly 6 is typically positioned close to the cylinder device 3. In other words, the overload relief valve 10 that is included in the load supporting valve assembly 6 is also positioned closed to the cylinder device 3, which is far away from the construction machine body.

However, the tank is typically placed around the construction machine body. Accordingly, as the overload relief valve 10 is distanced from the construction machine body, a pipe for connecting the overload relief valve 10 with the tank becomes longer.

The connecting pipe needs to be of significant capacity since the overload relief valve 10 is for the escape of overloading pressure. Therefore, such a long connecting pipe causes increases in cost and size.

SUMMARY OF THE INVENTION

The first object of the present invention is to provide a hydraulic control system capable of preventing an objective from rapidly dropping down, for example, when the load supporting passage 5 is fractured in an operation for moving the objective downward with a hydraulic shovel in a craning work. The second object of the present invention is to provide a hydraulic control system allowing reductions in cost and size due to needlessness of the arrangement of the overload relief valve 10 to connect to a passage between the bottom pressure chamber 3*a* of the cylinder device 3 and the pilot check valve 7.

The present invention is based on the premises that a hydraulic control system has: a pump; a cylinder device; a pressure chamber provided in the cylinder device and generating a load pressure; a control valve blocking the cylinder device from the pump in its neutral position, and introducing a discharged oil from the pump into the pressure chamber of the cylinder device to move up a work load when switching to an upward position, and discharging the hydraulic fluid in the pressure chamber of the cylinder device to move down the work load when switching to a downward position; pilot pressure control means for controlling a pilot pressure for shifting the control valve to the upward position or the downward position; a pilot check valve arranged between the pressure chamber of the cylinder device and the control valve; and a back pressure chamber, provided in the pilot check valve, that receives the load pressure in the pressure chamber of the cylinder device, in which the pilot check valve blocks the flow from the pressure chamber of the cylinder device when the pressure in the back pressure chamber of the pilot check valve is equal to the load pressure in the pressure chamber of the cylinder device, and the pilot check valve is opened to receive the flow from the pressure chamber of the cylinder device when the hydraulic fluid in the back pressure chamber of the pilot check valve is discharged.

The first invention is featured in that the hydraulic control system includes: a bypass for connecting the pressure chamber of the cylinder device with a load supporting passage between the control valve and the pilot check valve; first selector means for blocking the bypass in its normal state, and for establishing a communication between a pressure chamber of the pilot check valve and the load supporting passage via a throttle in its switching state; and second selector means for maintaining the pressure in the back pressure chamber of the pilot check valve at the same value as the load pressure of the pressure chamber of the cylinder device in a normal state, and for discharging the hydraulic fluid in the back pressure chamber in its switch state, in which the first and second selector means switch by the pilot pressure for switching the control valve to the downward position, and only the first selector means switches when a value of the pilot pressure is less than a predetermined value, and the second selector means as well as the first selector means switches when a value of the pilot pressure exceeds the predetermined value.

The second invention is featured in that the hydraulic control system in the first invention further includes a variable throttle, varying the degree of opening thereof in accordance with the amount of pushing-up of a valve member of the pilot check valve, on a passage between the back pressure chamber of the pilot check valve and the pressure chamber of the cylinder device.

The third invention is featured in that, in the hydraulic control system in the first or second invention, the first selector means has three positions: a normal position for blocking a fluid connection between the pressure chamber of the cylinder device and the load supporting passage; a first switch position for establishing a fluid connection between the pressure chamber of the cylinder device and the load supporting passage via the throttle; and a second switch position for blocking the fluid connection between the pressure chamber of the cylinder device and the load supporting passage. The first selector means switches to the first switch position when a value of the pilot pressure is less than a predetermined value, and switches to the second swith position when a value of the pilot pressure exceeds the predetermined value.

The fourth invention is featured in that the hydraulic control system in the first to third inventions further includes: an overload relief valve connecting to the load supporting passage between the control valve and the pilot check valve; a relief valve connecting to a passage between the pressure chamber of the cylinder device and the pilot check valve; and an orifice arranged downstream from the relief valve, in which the second selector means switches by the pressure produced in the upstream of the orifice when the relief valve opens.

The fifth invention is featured in that, in the hydraulic control system in the first to fourth inventions, the pilot check valve is structured by incorporating the valve member into a sliding hole formed in a body. An end of the valve member connects with a port for connecting with the control valve. A nose portion having an internal passage is provided at the end of the valve member, and has small holes, having a small opening area and opening toward the internal passage, in the proximal end thereof. The port connecting with the control valve and a port connecting with the pressure chamber of the cylinder device are connected via the above small holes when the second selector means switches.

BRIEF DESCRIPTION OF THE DRAWINGS

FIG. 11 is a circuit diagram of a hydraulic control system according to prior art.

DETAILED DESCRIPTION OF THE PREFERRED EMBODIMENTS

Figure 1:
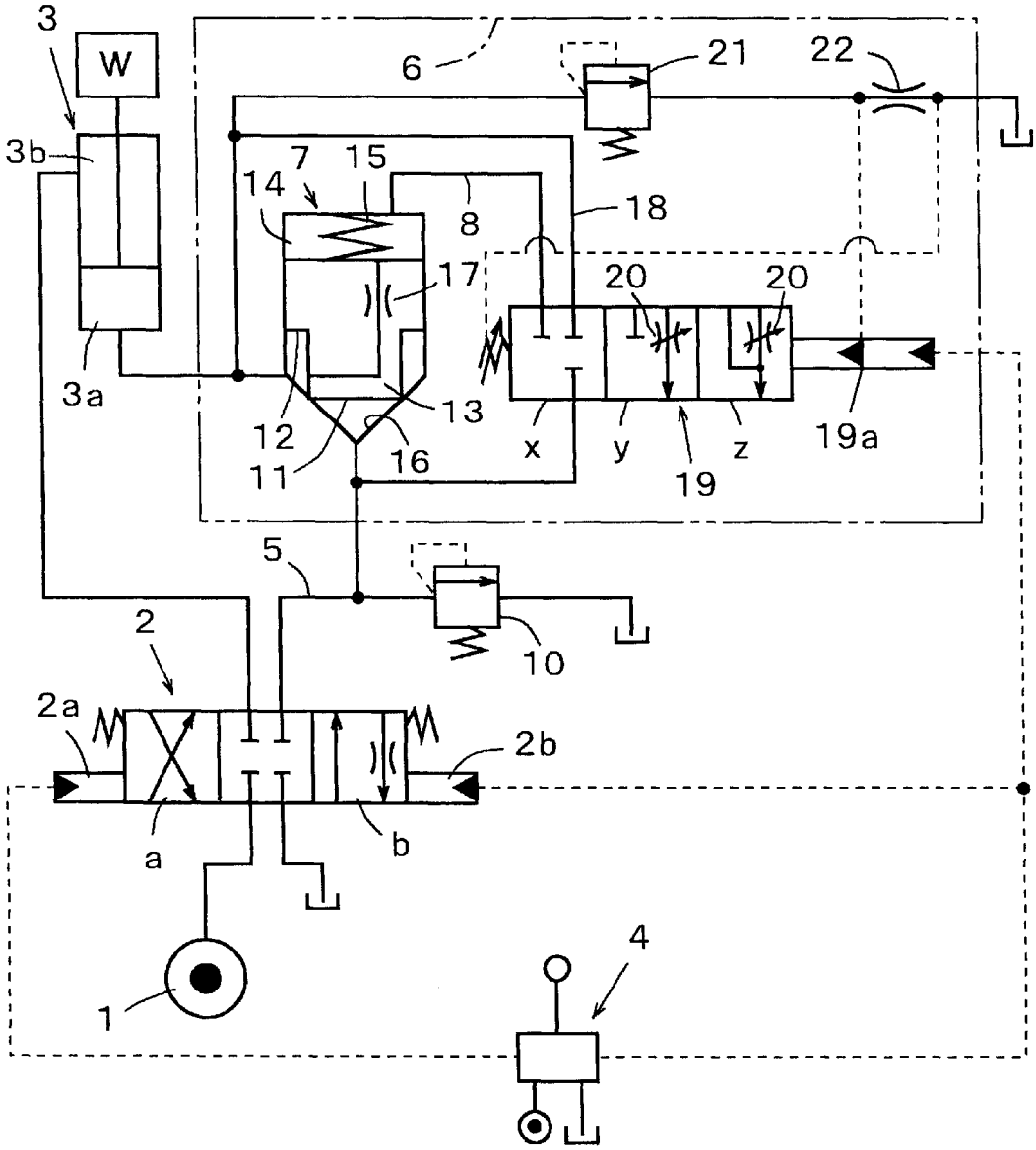
FIG. 1 is a circuit diagram of a hydraulic control system of a first embodiment according to the present invention.
Figure 2:
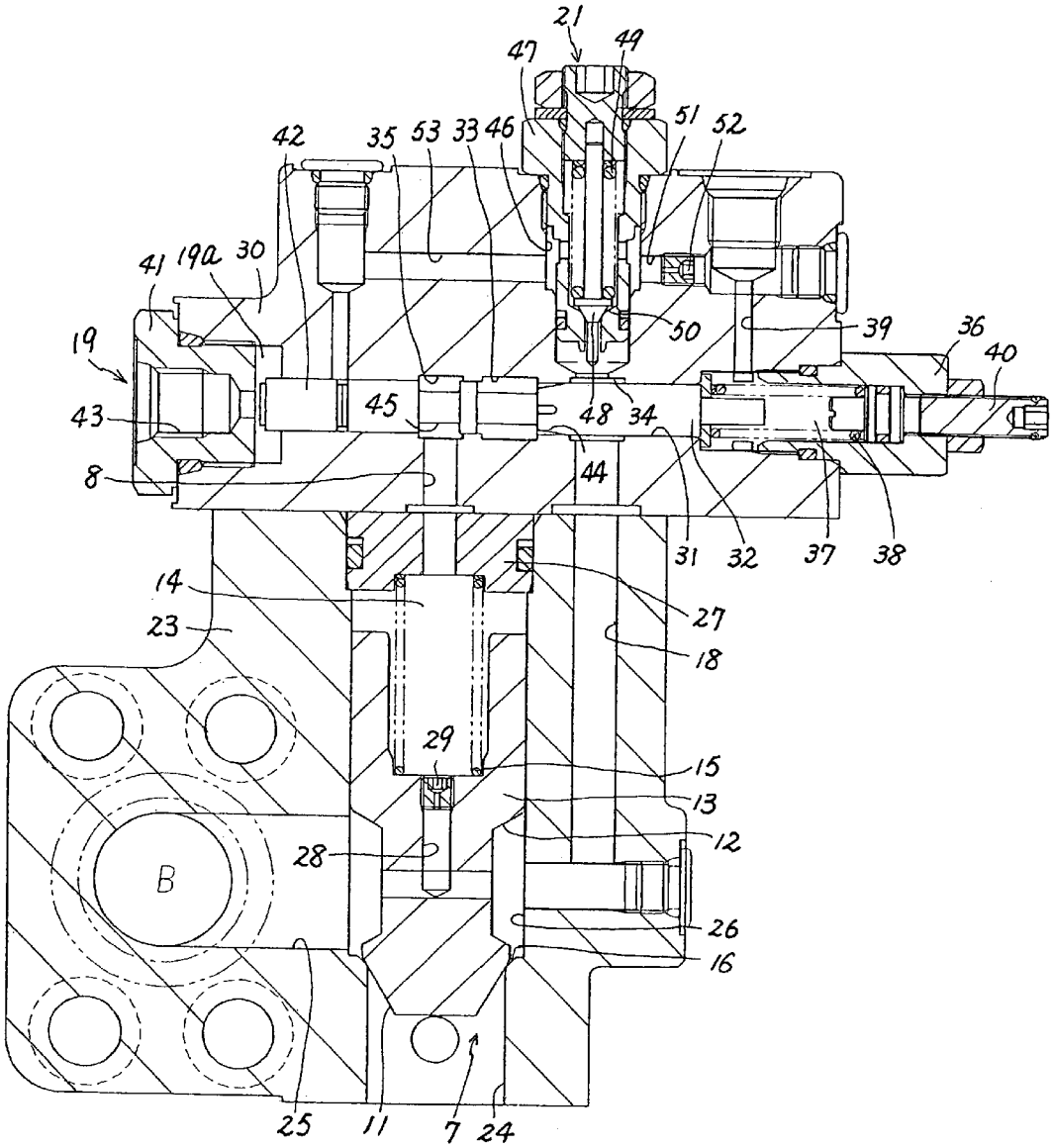
FIG. 2 is a sectional view showing a structure of a load supporting valve assembly 6 in the hydraulic control system of the first embodiment.

FIGS. 1 and 2 show a first embodiment of a hydraulic control system in accordance with the present invention. In the first embodiment, the structure of the load supporting valve assembly 6 is changed, but the rest of the fundamental circuit configuration is similar to that illustrated in Description of the Related Art. Accordingly, the different points from the hydraulic control system of the prior art will be principally described below, and the same reference numerals will be used to designate components the same as or similar to those used in Description of the Related Art, and therefore the description thereof will be omitted.

As shown in FIG. 1, the pilot check valve 7 has a valve member 13. From this a first pressure receiving face 11 is formed on an end portion of the valve member 13, and a second pressure receiving face 12 is formed on a side portion thereof. A spring 15 is provided in a back pressure chamber 14 formed in the back of the valve member 13. The valve member 13 is seated in a valve seat 16 by an elastic force of the spring 15.

The fluid connection between the load supporting passage 5 and the bottom pressure chamber 3*a* of the cylinder device 3 is blocked whenever the valve member 13 is seated in the valve seat 16. At this time, the first pressure receiving face 11 of the valve member 13 receives pressure from the load supporting passage 5, and the second pressure receiving face 12 receives a load pressure from the bottom pressure chamber 3*a*. The load pressure in the bottom pressure chamber 3*a* is introduced into the back pressure chamber 14 via a throttle passage 17 formed in the valve member 13.

The pilot passage 8 is connected to the back pressure chamber 14 of the pilot check valve 7 designed as mentioned above.

A bypass 18 is connected to a passage between the bottom pressure chamber 3*a* of the cylinder device 3 and pilot check valve 7.

The pilot passage 8 and the bypass 18 are provided with a selector valve 19.

The selector valve 19 has three positions: blocking position x, first communicating position y, and second communicating position z. The blocking position x closes both the pilot passage 8 and the bypass 18. The first communicating position y establishes communication between the bypass 18 and the load supporting passage 5 via a throttle 20, while closing the pilot passage 8. The second communicating position z establishes communications between both the pilot passage 8 and the bypass 18 and the load supporting passage 5.

The selector valve 19 is normally in the blocking position x, and switches to the first communicating position y when the pilot pressure less than a predetermined value is introduced into a pilot chamber 19*a*. If the pilot pressure exceeding the predetermined value is introduced into the pilot chamber 19*a*, the selector valve 19 switches to the second communicating position z.

Into the pilot chamber 19*a* of the selector valve 19 as designed above, the pilot pressure in the pilot chamber 2*b* of the control valve 2 is introduced.

It should be mentioned that in the first embodiment the overload relief valve 10 is not connected to the passage between the bottom pressure chamber 3*a* of the cylinder device 3 and the pilot check valve 7, but is connected to the load supporting passage 5.

The load supporting valve assembly 6 includes a relief valve 21 smaller in size than the overload relief valve 10. The relief valve 21 is connected to the passage between bottom pressure chamber 3*a* and pilot check valve 7. In downstream of the relief valve 21, an orifice 22 is arranged and introduces pressure upstream toward the pilot chamber 19*a* of the selector valve 19.

Operation of the hydraulic control system of the first embodiment will be explained below.

As shown in FIG. 1, when the control valve 2 is in a neutral position, the discharged oil from the pump 1 is not introduced into neither the bottom pressure chamber 3*a* nor the rod-side pressure chamber 3*b* of the cylinder device 3.

Here, the pilot pressure is not also introduced into the pilot chamber 19*a*, and the selector valve 19 is in the blocking position x, so that the pressure in the back pressure chamber 14 of the pilot check valve 7 is maintained by the load pressure of the bottom pressure chamber 3*a*. The valve member 13, thus, is continued to seat in the valve seat 16 by the pressure effect, caused by the load pressure in the back pressure chamber 14, and the elastic force of the spring 15, so as to block flow from the bottom pressure chamber 3*a* of the cylinder device 3, whereby the work load W is assuredly held.

On an operation for moving up the work load W, the pilot pressure is introduced from the pilot valve 4 into the pilot chamber 2*a* so that the control valve 2 switches to the upward position a (the left side of the drawing).

By switching control valve 2 to the upward position, the injected pressure of the pump 1 affects the first pressure receiving face 11 of the valve member 13 of the pilot check valve 7. Even after the control valve 2 has switched to the upward position a, the selector valve 19 is still in the blocking position, so that the pressure in the back pressure chamber 14 of the pilot check valve 7 is maintained by the load pressure of the bottom pressure chamber 3*a* of the cylinder device 3. Accordingly, when the pressure effect acting on the first pressure receiving face 11 of the valve member 13 exceeds the pressure effect caused by the load pressure in the back pressure chamber 14 and the elastic force of the spring 15, the valve member 13 moves away from the valve seat 16 so as to flow oil discharged from the pump 1 toward the bottom pressure chamber 3*a*.

The hydraulic fluid in the rod-side pressure chamber 3*b* of the cylinder device 3 is also discharged into the tank when the control valve 2 switches to the upward position a.

Thus, the discharged oil from the pump 1 is introduced into the bottom pressure chamber 3*a* of the cylinder device 3, while the hydraulic fluid in the rod-side pressure chamber 3*b* is discharged into the tank, thereby moving upward the work load W.

On the other hand, on an operation for moving down the work load W, the pilot pressure is introduced from the pilot valve 4 into the pilot chamber 2*b* so that the control valve 2 switches to the downward position b (the right side of the drawing).

At this time, the pilot pressure is also introduced into the pilot chamber 19*a* so that the selector valve 19 switches.

If the introduced pilot pressure is less than a predetermined value, the selector valve 19 switches to the first communicating position y.

In the first communicating position y, the pilot passage 8 is still closed, so that the pressure in the back pressure chamber 14 of the pilot check valve 7 is maintained by the load pressure in the bottom pressure chamber 3*a*. Therefore, the pressure effect caused by the load pressure in the back pressure chamber 14 and the elastic force of the spring 15 allow the valve member 13 to remain positioned in the valve seat 16, thereby blocking the flow from the bottom pressure chamber 3 a of the cylinder device 3.

In the first communicating position y, however, since the bypass 18 communicates with the load supporting passage 5 via the throttle 20, the hydraulic fluid in the bottom pressure chamber 3*a* of the cylinder device 3 is introduced from the bypass 18 through the throttle 20 into the control valve 2. In consequence, the hydraulic fluid in the bottom pressure chamber 3*a* is discharged into the tank in accordance with the degree of opening the throttle 20 and the degree of opening the control valve 2, thereby moving down the work load W.

Oppositely, if the introduced pilot pressure exceeds the predetermined value, the selector valve 19 switches to the second communicating position z.

In the second communicating position z, the pilot passage 8 communicates with the load supporting passage 5, so that a differential pressure is produced before and behind throttle passage 17. The pressure in the back pressure chamber 14 is decreased for the differential pressure, hence the pressure effect of the back pressure chamber 14 reduces in force which is applied for closing the valve member 13.

If a force produced by acting the load pressure in the cylinder device 3 on the second pressure receiving face 12 overcomes a force applied by the back pressure chamber 14 and the elastic force of the spring 15, the valve member 13 moves away from the valve seat 16. After the separation of the valve member 13 from the valve seat 16, most of the hydraulic fluid in the bottom pressure chamber 3*a* of the cylinder device 3 is passed through the pilot check valve 7 and the control valve 2, and then discharged into the tank. In other words, the selector valve 19 in the second communicating position z is almost equal in function to a condition in which the pilot check valve 7 is opened in the aforementioned hydraulic control system of prior art.

Next, the relationship between the pilot pressure introduced into the pilot chamber 19*a* and the process of the hydraulic shovel working will be explained.

In the crane operation for moving an objective downward with the hydraulic shovel, the objective slowly moves down by the slight shift of the control valve 2 to the downward position b. That is to say, the pilot pressure to be introduced into the pilot chamber 2*b* of the control valve 2, which is generated within a range below a predetermined pressure.

In other words, in the crane operation for moving down the objective, the pilot pressure to be introduced into the pilot chamber 19*a* of the selector valve 19 is also less than a predetermined pressure, so that the selector valve 19 switches to the first communicating position y.

If the load supporting passage 5 is fractured or the like while the selector valve 19 is being in the first communicating position y, since the throttle 20 is positioned upstream from the fractured section, the hydraulic fluid of the bottom pressure chamber 3*a* of the cylinder device 3 is avoided rapidly escaping from the fracture section on the load supporting passage 5. Thus, the objective is prevented from rapidly dropping and damaging.

For a ground-excavating operation or a leveling operation with the hydraulic shovel, since a large oil flow is required, the control valve 2 maximumly switches to the downward position. Thereupon, a pilot pressure to be introduced into the pilot chamber 2*b* of the control valve 2 is generated in a range above a predetermined pressure.

In other words, in the ground-excavating operation or leveling operation, a pilot pressure to be introduced into the pilot chamber 19*a* of the selector valve 19 also exceeds a predetermined pressure, thereby the selector valve 19 switches to the second communicating position z.

If the load supporting passage 5 is fractured or the like while the selector valve 19 is in the second communicating position z, similar to the hydraulic control system of prior art, the hydraulic fluid in the bottom pressure chamber 3*a* of the cylinder device 3 instantly escapes from the fractured section on the load supporting passage 5. In this case, however, force required for the ground-excavating operation or leveling operation becomes insufficient, and there is no disadvantage of the rapidly dropping of objective in contract to the previously described crane operation.

Meanwhile, the sum of the degree of opening T of the control valve 2 in the downward position b and the degree of opening t of the throttle 20 when the selector valve 19 is in the first communicating position y is somewhat decided by setting the moving-down speed of the work load W. On the premise this matter, the correlation between the degree of opening T and the degree of opening t can be defined, as follows, for example:

If the selector valve 19 is in the first communicating position y, it is advisable that the degree of opening t of the throttle 20 is set in a vale smaller than that of the degree of valve opening T, i.e., preferably, $T \geqq t$. This is to avoid the loss of hydraulic fluid in the bottom pressure chamber 3*a* of the cylinder device 3 when the load supporting passage 5 is fractured or the like, The fact that the degree of opening t of the throttle 20 is set to be smaller when the selector valve 19 is in the first communicating position y means that the hydraulic fluid in the bottom pressure chamber 3*a* is mainly controlled by the throttle 20. The bottom pressure chamber 3*a* has been mainly controlled at the degree of opening t of the throttle 20 while the selector valve 19 in the first communicating position y, but it becomes immediately controlled only at the degree of opening T of the control valve 2 when the selector valve 19 switches to the second communicating position z, resulting in an increase of flow fluctuation.

Considering the above factors, it is preferable to have properties in which when the selector valve 19 is in the first communication position y, the correlation is $T \geqq t$, and before the selector valve 19 completely switches from the first communicating position y to the second communicating position z, the correlation changes to $T<t$ while the sum degree of opening is not changed.

In the hydraulic control system of the first embodiment, when the work load W is maintained, in other words, when the control valve 2 is in the neutral position, if an external force is applied to the work load W, the load pressure in the bottom pressure chamber 3*a* of the cylinder device 3 is increased so as to open the relief valve 21. Pressure therefore is generated in the upstream of the orifice 22 and is introduced toward the pilot chamber 19*a* of the selector valve 19.

Here, the selector valve 19 is designed to switch until the second communicating position z when the pressure generated in the upstream of the orifice 22 is introduced toward the pilot chamber 19*a*. If the selector valve 19 switches to the second communicating position z, the pilot check valve 7 opens to allow the bottom pressure chamber 3*a* to communicate with the overload relief valve 10.

In consequence, even if the overload relief valve 10 is not connected to the passage between the bottom pressure chamber 3*a* and the pilot check valve 7, shock produced when the external force is applied to the work load W is absorbed and an abnormal increase of load pressure is avoided.

In the first embodiment as described above, due to the provision of the relief valve 21, the overload relief valve 10 is connected to the load supporting passage 5, but not connected to the passage between the bottom pressure chamber 3*a* of the cylinder device 3 and the pilot check valve 7. Therefore, the overload relief valve 10 can be arranged close to the construction machine body in which the tank is provided, which allows the length of a pipe for connecting the overload relief valve 10 with the tank to be shortened, resulting in reduction in cost and size.

As a matter of course, it is necessary to provide a pipe for connecting the relief valve 21, built in the load supporting valve assembly 6, with the tank provided in the construction machine body. However, the relief valve 21 is provided for generating pressure in the upstream of the orifice 22, which is much smaller in size than that of the overload relief valve 10. Thus, the capacity of pipe for connecting the relief valve 21 with the tank may be small, thereby avoiding increasing in size of the hydraulic control system.

In the aforementioned first embodiment, the bottom pressure chamber 3*a* of the cylinder device 3 constructs a pressure chamber of the cylinder device according to the present invention.

The pilot valve 4 constructs a pilot pressure control means according to the present invention.

Moreover, the selector valve 19 constructs a first selector means and a second selector means according to the present invention. More specifically, while switching to the first communication position y, the selector valve 19 functions as the first selector means, and while switching to the second communicating position z, the selector valve 19 functions as the first and second selector means.

FIG. 2 shows a detailed structure of the load supporting valve assembly 6 in the hydraulic control system on the above first embodiment. In the below explanation, the same reference numerals will be used for the elements illustrated in the circuit diagram of FIG. 1.

The structure of the pilot check valve 7 will be first explained in detail.

In a first body 23, a port 24 communicating with the load supporting passage 5 (not shown), and a passage 25 communicating with the bottom pressure chamber 3*a* of the cylinder device 3 (not shown) are formed.

The first body 23 has a sliding hole 26, and the valve member 13 is slidably inserted therein. At an end portion of the valve member 13, the first pressure receiving face 11 is formed, and on the side portion thereof, the step-shaped second pressure receiving face 12 is formed.

The sliding hole 26 is closed by a spring shoe member 27, and the back pressure chamber 14 is formed in the back of the valve member 13. This allows the elastic force of the spring 15 attached in the back pressure chamber 14 to act on the valve member 13. The valve member 13, therefore, seats in the valve seat 16 so as to block between the port 24 and the passage 25. In this state, the pressure in the load supporting passage 5 communicating with the port 24 acts on the first pressure receiving face 11 of the valve member 13, and the load pressure in the bottom pressure chamber 3*a* of the cylinder device 3 which communicates with the passage 25 acts on the second pressure receiving face 12.

Into the back pressure chamber 14, the load pressure in the bottom pressure chamber 3*a* is introduced via a passage 28 formed in the valve member 13. In a middle portion of passage 28, a throttle member 29 is incorporated. In other words, the passage 28 and the throttle member 29 cooperatively construct the throttle passage 17 illustrated in FIG. 1.

Note that the bypass 18 is formed in the first body 23, and the pressure in the passage 25, namely, the load pressure in the bottom pressure chamber 3*a* of the cylinder device 3 is introduced into the bypass 18.

Onto the above first body 23, a second body 30 is secured. The selector valve 19 and the relief valve 21 are incorporated in the second body 30.

The structure of the selector valve 19 will be now explained in detail.

In the second body 30, a spool hole 31 is formed, and a spool 32 is slidably inserted therein.

In a central region of the second body 30, a port 33 is formed and connected to the load supporting passage 5 (not shown). In the right side of the port 33 of the drawing, a port 34 communicating with the bypass 18 is formed, and in the left side thereof, a port 35 communicating with the pilot passage 8 is formed.

In the right side of the drawing, a cap 36 is attached to an end portion of the second body 30, and a spring case 37 is formed in an end portion of the spool hole 31. The spool 32 receives an elastic force of a spring 38 provided in the spring case 37. Note that the spring case 37 is communicated with a tank passage 39 formed in the second body 30. In addition, an adjuster 40 is incorporated in the cap 36, whereby an initial load of the spring 38 is optionally changed.

In the left side of the drawing, a cap 41 is attached to the other end portion of the second boy 30, and the pilot chamber 19*a* is formed in the other end portion of the spool hole 31. In this point, the pilot chamber 19*a* is not directly connected to the spool 32, but is connected to a sub-spool 42 adjacent to the spool 32. Into the pilot chamber 19*a*, the pilot pressure in the pilot chamber 2*b* of the control valve 2 (not shown) is introduced via a pilot port 43 formed in the cap 41.

As shown in FIG. 2, while the spool 32 is in a normal state, the fluid connections between the port 33 and the port 34 and between the port 33 and the port 35 are blocked. In this state, both the pilot passage 8 and the bypass 18 are closed and the selector valve 19 is in the blocking position x.

In the normal state, upon introducing a pilot pressure into the pilot chamber 19*a*, the introduced pilot pressure affects a side face of the sub-spool 42. Therefore, the spool 32 is pushed by the sub-spool 42 and moved against the spring 38, and the port 33 and the port 34 mutually communicate via a notch 44. The communication between the port 33 and the port 34 via the notch 44 means that the bypass 18 communicates with the load supporting passage 5 via the throttle 20, and that the selector valve 19 switches to the first communicating position y.

If the spool 32 is further moved, the port 33 communicate with, besides the port 34, the port 35 via at circular groove 45. The communication between the ports 33 and 35 means that the pilot passage 8 communicates with the load supporting passage 5, and that the selector valve 19 switches to the second communicating position z.

Continuously, a structure of the relief valve 21 will be explained specifically.

In the second body 30, an attaching hole 46 is formed to communicate with the above port 34. In the attaching hole 46, a valve holding member 47 is fixedly inserted.

Inside the valve holding member 47, a poppet 48 is incorporated. The poppet 48 receives an elastic force of a spring 49, and thereby is seated in a valve seat 50 formed inside the valve holding member 47.

In the second body 30, a first communication passage 51 moving the pressure in the back side of the poppet 48 toward the aforementioned tank passage 39, is formed. In an area of the first communication passage 51, a throttle member 52 constituting the orifice 22 is mounted.

Moreover, in the second body 30, a second communication passage 53 is formed adjacent the aforementioned attaching hole 46 to be opposite to the first communication passage 51. An end of the second communication passage 53 communicates with the first communication passage 51, and the other end thereof opens toward the spool hole 31. In the normal state of the spool 32, as shown in FIG. 2, the opened portion of the second communication passage 53 facing toward the spool hole 31 is designed to positionally correspond to the abutting portion of the spool 32 and the sub-spool 42.

As mentioned hereinbefore, while the work load W is supported, in other words, while the control valve 2 (not shown) is in the normal state, if the external force is applied to the work load W, the load pressure in the bottom pressure chamber 3*a* of the cylinder device 3 increases. Therefore, the pressure in the bypass 18 increases, and the poppet 48 is moved away from the valve seat 50 by the pressure effect. By separating of the poppet 48 from the valve seat 50, the hydraulic oil in the bypass 18 flows toward the back side of the poppet 48 and is also introduced into the first communication passage 51, so that pressure is generated in the upstream of the throttle member 52.

The pressure generated in the upstream of the throttle member 52 is introduced from the second communication passage 53 into the spool hole 31, thereafter acts on both the abutting faces of the sub-spool 42 and the spool 32. Thereby, the sub-spool 42 and the spool 32 are moved away from each other, so that the spool 32 is shifted to the second communicating position z for establishing the fluid connection between the ports 33 and 35.

Figure 3:
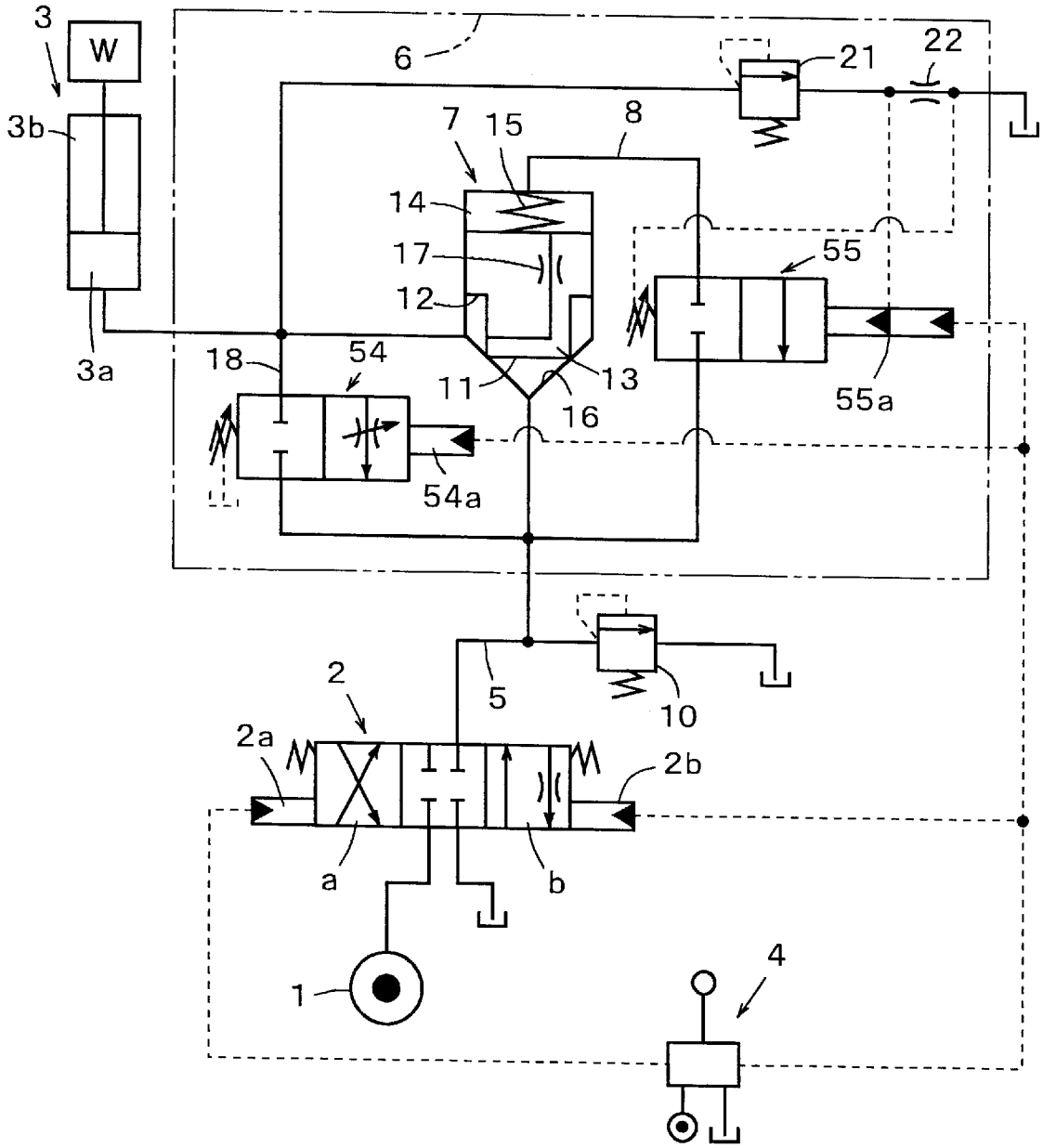
FIG. 3 is a circuit diagram of a hydraulic control system of a second embodiment according to the present invention.

In a second embodiment shown in FIG. 3, a first selector valve 54 and a second selector valve 55 together serve the same function as the selector valve 19 explained in the first embodiment.

As shown in FIG. 3, the bypass 18 is connected to the first selector valve 54. In the normal state, the first selector valve 54 is in a blocking position for closing the bypass 18. If the pilot pressure is introduced into a pilot chamber 54*a*, the first selector valve 54 switches to a communicating position so as to establish the communication between the bypass 18 and the load supporting passage 5.

The pilot passage 8 is connected to the second selector valve 55. In the normal state, the second selector valve 55 is in a blocking position for closing the pilot passage 8. If the pilot pressure is introduced into a pilot chamber 55*a*, the second selector valve 55 switches to a communicating position so as to establish the communication between the pilot passage 8 and the load supporting passage 5.

Into the pilot chambers 54*a* and 55*a* of the respective first and second selector valves 54 and 55, a pilot pressure in the pilot chamber 2*b* of the control valve 2 is introduced. When the pilot pressure is less than a predetermined value, only the first selector valve 54 switches to the communicating position, and when it exceeds the predetermined value, the second selector valve 55 also switches to the communicating position.

In the second embodiment as described above, when an objective is lifted down with the hydraulic shovel in the crane operation, a pilot pressure introduced into the pilot chamber 2*b* of the control valve 2 is less than the predetermined value, so that only the first selector valve 54 switches to the communicating position. In consequence, even if the load supporting passage 5 is fractured or the like, the objective is prevented from rapidly dropping and crashing.

In addition, the individual provision of the first and second selector valves 54 and 55 enables the select timing for switching in each of the valves. Thus, the first and second selector valves 54 and 55 can respectively switch at appropriate timings in dependence on an arrangement with another machine or the like.

Meanwhile, in the second embodiment, the pressure in the upstream of the orifice 22 is introduced toward the pilot chamber 55*a* of the second selector valve 55. The relief valve 22 opens and a pressure is generated in the upstream of the orifice 22, thereupon the second selector valve 55 switches to the communicating position.

In the second embodiment, while the work load W is supported, in other words, while the control valve 2 is in the neutral position, even if the external force is applied to the work load W, the pilot check valve 7 opens and thereby the bottom pressure chamber 3*a* of the cylinder device 3 is also connected with the overload relief valve 10, resulting in absorption of shock caused by the external force. It is not necessary to connect the overload relief valve 10 to the passage between the bottom pressure chamber 3*a* and the pilot check valve 7, thus allowing reduction in cost and size.

Figure 4:
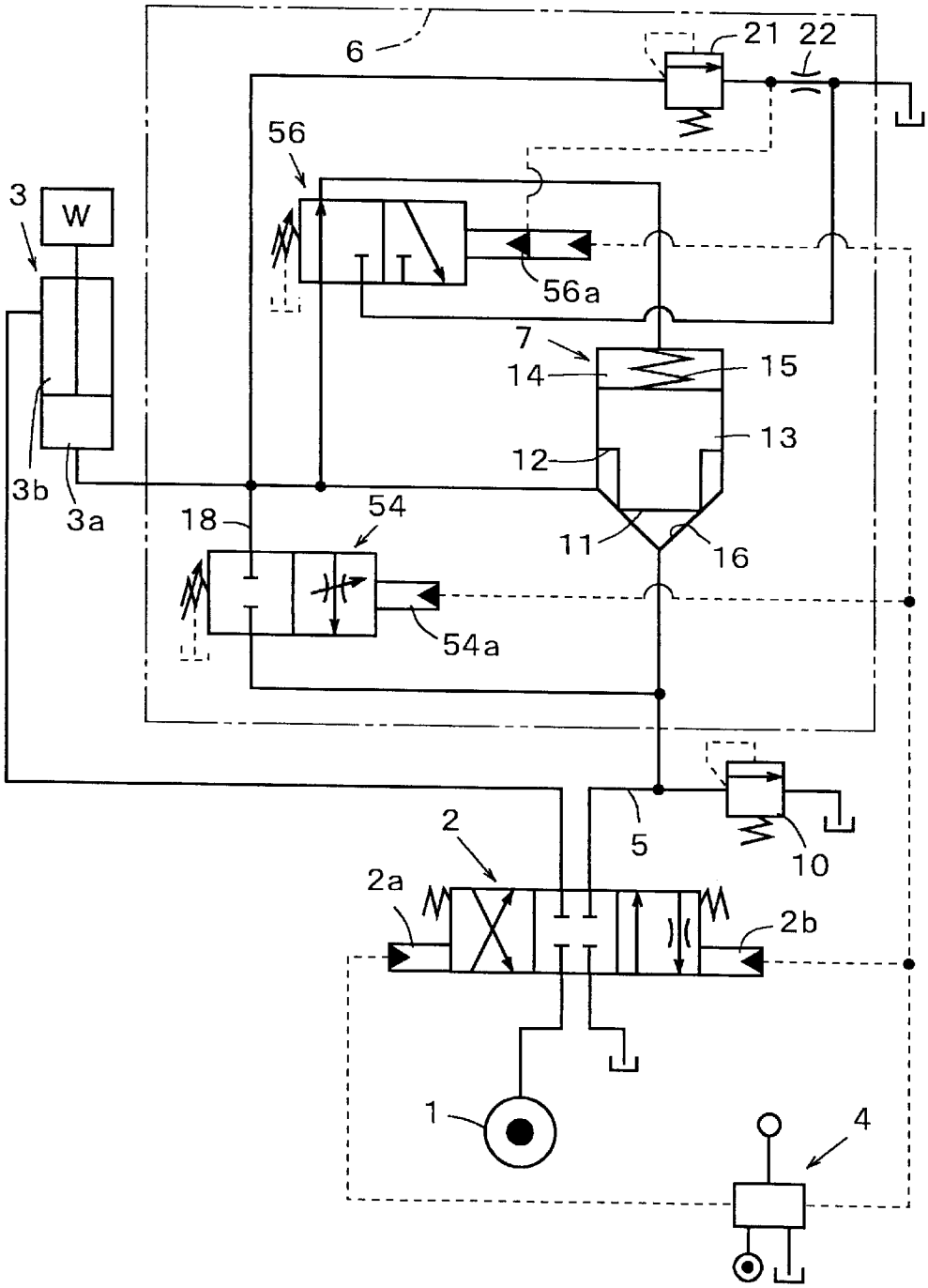
FIG. 4 is a circuit diagram of a hydraulic control system of a third embodiment according to the present invention.

In a third embodiment shown in FIG. 4, comparing with the second embodiment, the structure of the pilot check valve 7 is changed and another second selector valve 56 different from the second selector valve 55 is provided. The first selector valve 54 is the same as that described in the second embodiment.

As shown in FIG. 4, in the valve member 13 of the pilot check valve 7, the throttle passage 17, illustrated in FIGS. 1 and 3, is not formed. The load pressure in the bottom pressure chamber 3*a* of the cylinder device 3 is introduced into the back pressure chamber 14 of the pilot check valve 7 via the second selector valve 56.

In the normal state, the second selector valve 56 introduces the load pressure in the bottom pressure chamber 3*a* of the cylinder device 3 into the back pressure chamber 14 of the pilot check valve 7. In this state, since the pressure in the back pressure chamber 14 is maintained by the load pressure in the bottom pressure chamber 3*a* of the cylinder device 3, the pilot check valve 7 performs a normal check function. The pilot pressure is introduced into the pilot chamber 56*a*, thereupon the second selector valve 56 switches so as to establish a fluid connection between the back pressure chamber 14 and the tank. In this state, the hydraulic fluid in the back pressure chamber 14 is discharged, so that the check function of the pilot check valve 7 is released.

Similar to the second embodiment, the pilot pressure in the pilot chamber 2*b* of the control valve 2 is introduced into the pilot chambers 54*a* and 56*a* of the respective first and second selector valves 54 and 56. In the pilot pressure less than a predetermined value, only the first selector valve 54 switches to the communicating position, and in the pilot pressure exceeding the predetermined value, the second selector valve 56 also switches.

In the third embodiment as described above, when an objective is moved down with the hydraulic shovel in the crane operation, the pilot pressure introduced into the pilot chamber 2*b* of the control valve 2 is less than the predetermined value, so that only the first selector valve 54 switches to the communicating position. In consequence, even if the load supporting passage 5 is fractured or the like, the objective is prevented from rapidly dropping and damaging.

In the third embodiment, the pressure in the upstream of the orifice 22 is introduced toward the pilot chamber 56*a* of the second selector valve 56. The relief valve 22 opens and a pressure is generated in the upstream of the orifice 22, thereupon the second selector valve 56 switches to the communicating position.

According to the third embodiment, while the work load W is supported, in other words, while the control valve 2 is in the neutral position, even if the external force is applied to the work load W, the pilot check valve 7 opens and thereby the bottom pressure chamber 3*a* of the cylinder device 3 is connected with the overload relief valve 10, resulting in absorption of shock caused by the external force. It is not necessary to connect the overload relief valve 10 to the passage between the bottom pressure chamber 3*a* and the pilot check valve 7, thus allowing reduction in cost and size.

Figure 5:
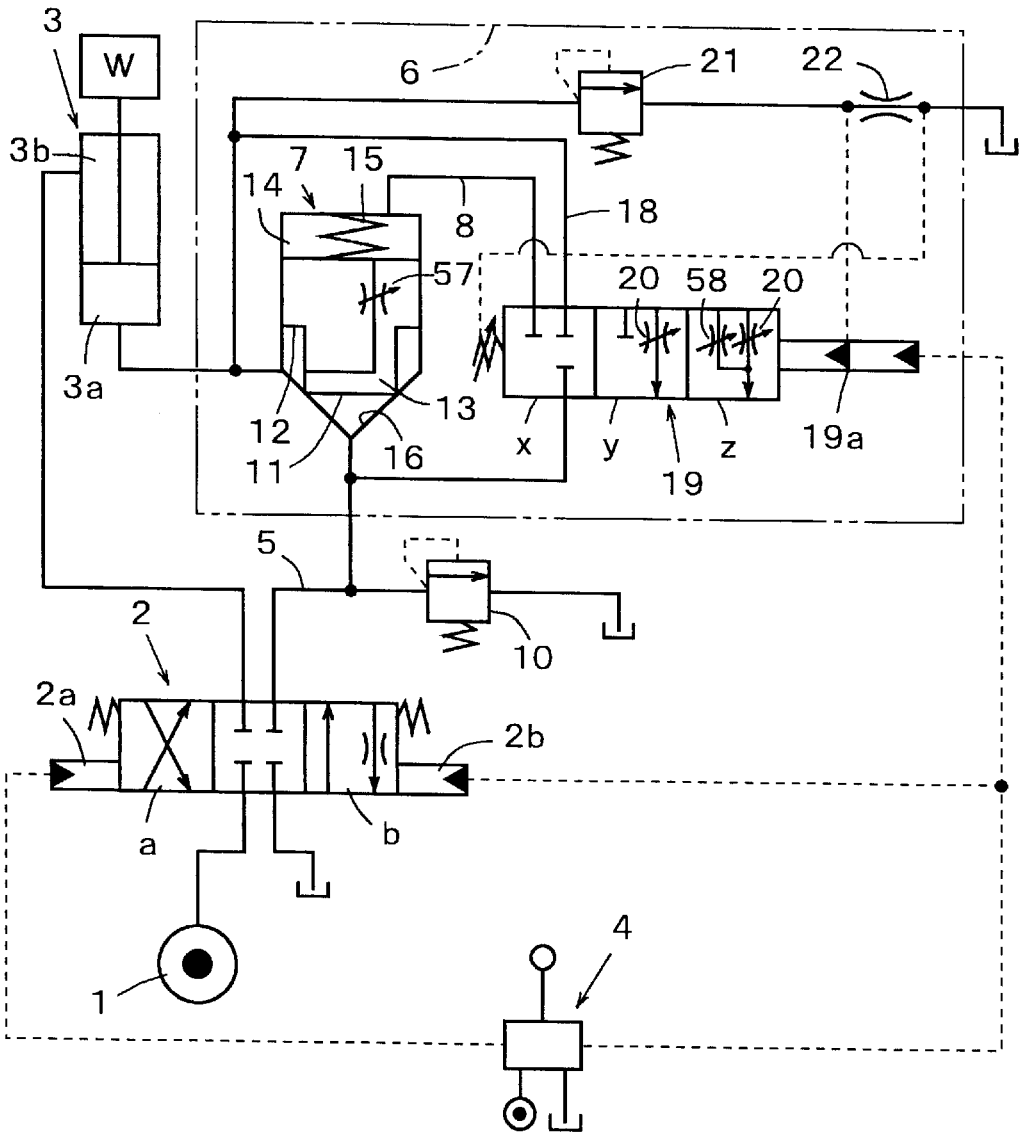
FIG. 5 is a circuit diagram of a hydraulic control system of a fourth embodiment according to the present invention.
Figure 6:
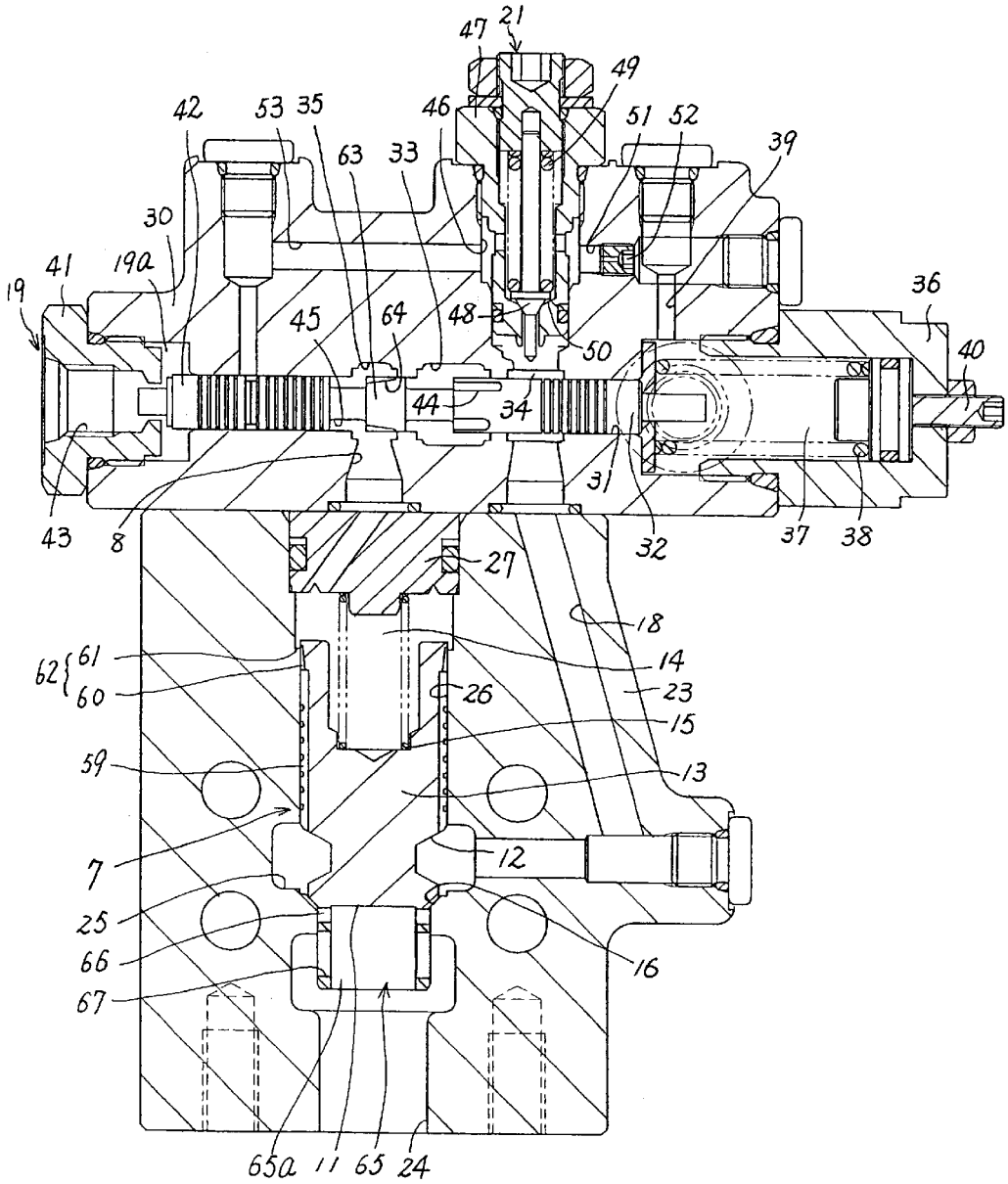
FIG. 6 is a sectional view showing a structure of a load supporting valve assembly 6 in the hydraulic control system of the fourth embodiment.

A fourth embodiment shown in FIGS. 5 and 6 has features in that instead of the throttle passage 17 provided in the pilot check valve 7 in the first embodiment (see FIGS. 1 and 2), a variable throttle passage 57 is formed; that the back pressure chamber 14 of the pilot check valve 7 and the load supporting passage 5 are connected via a throttle 58 when the second selector means 19 is in the second communicating position z; and that a nose portion 65 is provided in the valve member 13 of the pilot check valve 7. The rest of structure in this embodiment is the same as that in the first embodiment.

As shown in FIG. 5, the pilot check valve 7 establishes a communication between the back pressure chamber 14 thereof and the bottom pressure chamber 3*a* of the cylinder device 3 via the variable throttle passage 56. FIG. 6 shows the structure of variable throttle passage 56 in detail. That is, on the sliding face of the valve member 13 of the pilot check valve 7, an axial oriented groove 59, and a tapered groove 60 connecting to the axial oriented groove 59 are formed. The tapered groove 60 and a step portion 61 formed in the upper end portion of the sliding hole 26 cooperatively construct a variable throttle 62. The hydraulic fluid in the bottom pressure chamber 3*a* is introduced from the passage 25 via the axial oriented groove 59 and the variable throttle 62 into the back pressure chamber 14.

As shown in the drawing, the degree of opening the variable throttle 62 is minimized in a condition in which the valve member 13 is pressed against the valve seat 16 and the degree increases as the valve member 13 is moved upward. In other words, the degree of opening the variable throttle 62 is increased with the increase of the degree of opening the pilot check valve 7.

In order to prevent the pilot check valve 7 from opening suddenly, the degree of opening the variable throttle 62 varies according to the degree of opening the pilot check valve 7 as explained above. The reasons will be explained below.

The pilot check valve 7 is opened by a differential pressure produced before and behind the variable throttle 62. The differential pressure is in inverse proportion to the degree of opening the variable throttle 62.

Therefore, if the degree of opening the variable throttle 62 is adapted to increase with the opening of pilot check valve 7, as the pilot check valve 7 is opened larger, the differential pressure before and behind variable throttle 62 is smaller, thus weakening a force to open the pilot check valve 7.

As explained above, thus, the pilot check valve 7 never opens suddenly, in other words, its opening area increases gently. By achieving to gently increase the opening area of the pilot check valve 7, a great quantity of flow never strongly and suddenly streams from the passage 25 toward the port 24.

Meanwhile, as shown in FIG. 5, the selector valve 19 in the second communicating position z establishes the communication between the load supporting passage 5 and the bottom pressure chamber 3*a* of the cylinder device 3 via the throttle 58. In this case, an opening area of the throttle 58 is smaller than that of the throttle 20 establishing the fluid connection between the back pressure chamber 14 and the load supporting passage 5.

The above process is necessary because throttle 58 serves only for making a flow for generating a predetermined differential pressure before and behind the variable throttle passage 57.

However, excessively small values of the degree of opening throttle 20 cause extreme reduction in the speed of the downward movement of the cylinder device 3. Hence a certain height of the degree of opening the throttle 20 is required.

As shown in FIG. 6, specifically, the throttle 58 is constructed by a notch 64 formed on a land portion 63 of the spool 32 of the selector valve 19.

When the spool 32 in a normal state shown in the drawing moves toward the right side of the drawing, the notch 64 establishes a fluid connection between the port 33 and the port 34, to introduce pressure oil in the back pressure chamber 14 into the load supporting passage 5 connecting to the port 33.

Furthermore, as shown in FIG. 6, a cylindrical nose portion 65 having a passage 65*a* therein is provided in an end portion of the valve member 13 of the pilot check valve 7. In the proximal end portion of the nose portion 65, a plurality of small holes 66 having a large opening area for communicating with the passage 65*a* is formed. In the distal end portion of the nose portion 65, a plurality of large holes 67 having a large opening area for communicating with the passage 65*a* is formed.

The valve member 13 in the state shown in the drawing is pushed up, thereupon the nose portion 65 having the holes 66 and 67 is moved upward together with the valve member 13, and opens the small holes 66 facing toward the passage 25 and then opens the large holes 67 facing toward the passage 25. In other words, as the amount of pushing-up of the valve member 13 is larger, a communication area between the port 24 and the passage 25 is larger, thus increasing the flow passing through the port 24 and the passage 25.

The amount of pushing-up of the valve member 13 is settled so that only the small holes 66 open toward the passage 25 when the cylinder device 3 is moved up, namely when the pilot check valve 7 is opened by the differential pressure before and behind variable throttle passage 57, and the small holes 66 and the large holes 67 open toward the passage 25 when the cylinder device 3 is moved down, namely when the first pressure receiving face 11 receives the pump pressure.

Regarding operation in the fourth embodiment, the explanation will be carried out about only the operation when the pilot valve 2 is in the downward position b, because the operations when the pilot valve 2 is in the neutral position and the upward position a in the embodiment are the same as those in the foregoing first embodiment.

When a pilot pressure is introduced into the pilot chamber 2*b* of the pilot valve 2 so that the pilot valve 2 switches to the downward position b, if the pilot pressure is less than a predetermined value, the selector valve 19 switches to the first communication position y. Thus, the bottom pressure chamber 3*a* of the cylinder device 3 and the load supporting passage 5 are connected via the throttle 20 of the selector valve 19, thereby the hydraulic fluid in the bottom pressure chamber 3*a* is discharged to the tank. In this time, pressure loss is produced in the throttle 20 of the selector valve 19 and the throttle of the control valve 2, so that the flow discharged to the tank is limited and the work load W is moved slowly down.

In the above state, if the pilot pressure exceeds the predetermined value, the selector valve 19 switches to the second communicating position z, and the back pressure chamber 14 of the pilot check valve 7 is also communicated via the throttle 58 with the load supporting passage 5. Thus, the pressure oil in the back pressure chamber 14 is discharged and flows through the variable throttle passage 57, thereby a differential pressure is produced before and behind passage 57.

The differential pressure is produced before and behind variable is throttle passage 57, thereupon the pilot check valve 7 opens. However, as described hereinbefore, the differential pressure between before and behind variable throttle passage 57 is decreased as the pilot check valve 7 open larger, so that the opening area of the pilot check valve 7 is slowly increased.

In consequence, a great quantity of hydraulic fluid is avoided strongly flowing from the bottom pressure chamber 3 a of the cylinder device 3 toward the load supporting passage 5 via the pilot check valve 7. The achievement of avoiding strong outflow of the hydraulic fluid from the bottom pressure chamber 3*a* effects no shock produced when the pilot check valve 7 opens.

In other words, according to the fourth embodiment, the pilot check valve 7 is controlled over its opening, thereby allowing the shock produced when it opens to ease.

When the cylinder device 3 is moved down as explained above, the valve member 13 of the pilot check valve 7 shown in FIG. 6 allows only the small holes 66 of the nose portion 65 to open toward the passage 25, so that even if the load supporting passage 5 is fractured in this condition, the flow discharged from the bottom pressure chamber 3*a* can be limited by the opening area of the small communicating holes 66. By limiting the flow discharged from the bottom pressure chamber 3*a* to a minimum, the work load W supported by the cylinder device 3 is prevented from rapidly dropping.

It should be mentioned that when the pilot valve 2 switches to the upward position a, as explained hereinbefore, the amount of pushing up the valve member 13 is settled to open also the large communicating holes 67 facing toward the passage 25, so that the pressure oil form the pump 1 is applied to the bottom pressure chamber 3*a* at a rate of flowing equal to the sum of the opening area of the small holes 66 and the opening area of the large holes 67.

As a result, the work load W of the cylinder device 3 is moved up swiftly.

Figure 7:
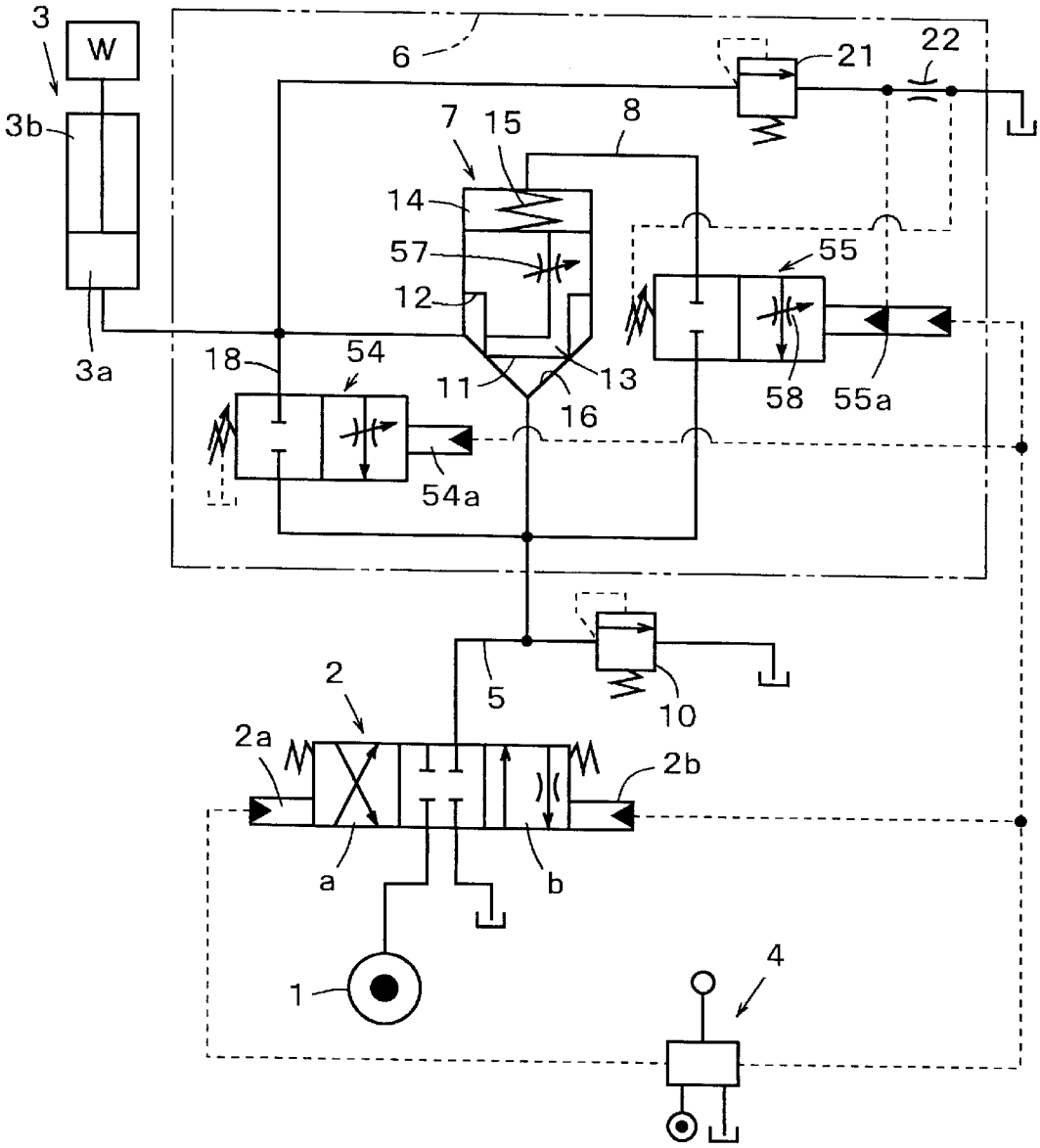
FIG. 7 is a circuit diagram of a hydraulic control system of a fifth embodiment according to the present invention.

In a fifth embodiment shown in FIG. 7, the above fourth embodiment is applied to the circuit in the foregoing second embodiment (FIG. 3). More specifically, in the fourth embodiment, the pilot check valve 7 is controlled by one selector valve 19. In the fifth embodiment, the pilot check valve 7 is controlled by the first selector valve 54 and the second selector valve 55, and also, the back pressure chamber 14 and the load supporting passage 5 are connected via the throttle 58 when the second selector valve 55 switches.

Similar to the fourth embodiment (FIG. 5), the variable throttle passage 57 is formed in the pilot check valve 7.

According to the fifth embodiment, after the first selector valve 54 has switched, if the second selector valve 55 is also shifted, similar to the fourth embodiment, the pilot check valve 7 opens slowly. In consequence, the shock produced when the pilot check valve 7 opens can still be avoided in the fifth embodiment.

Figure 8:
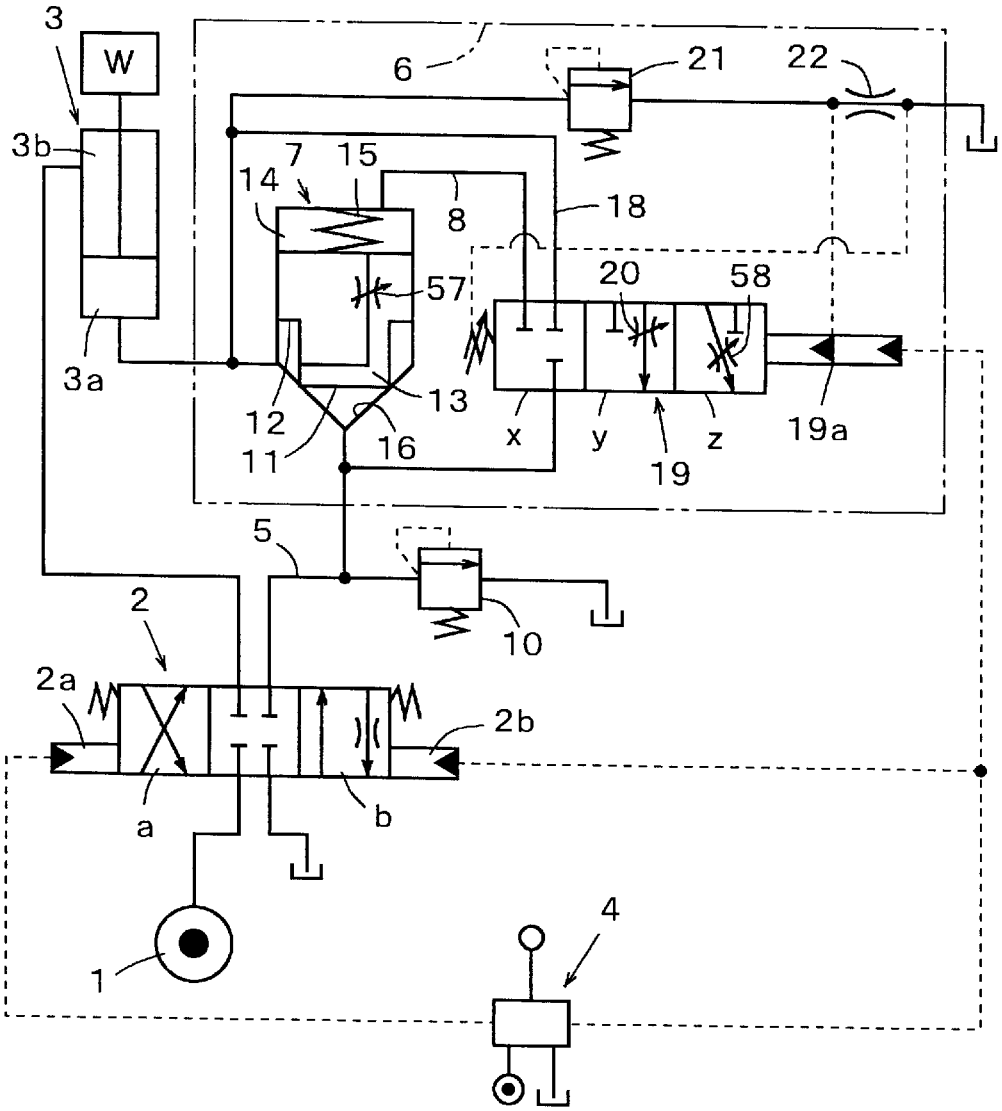
FIG. 8 is a circuit diagram of a hydraulic control system of a sixth embodiment according to the present invention.
Figure 9:
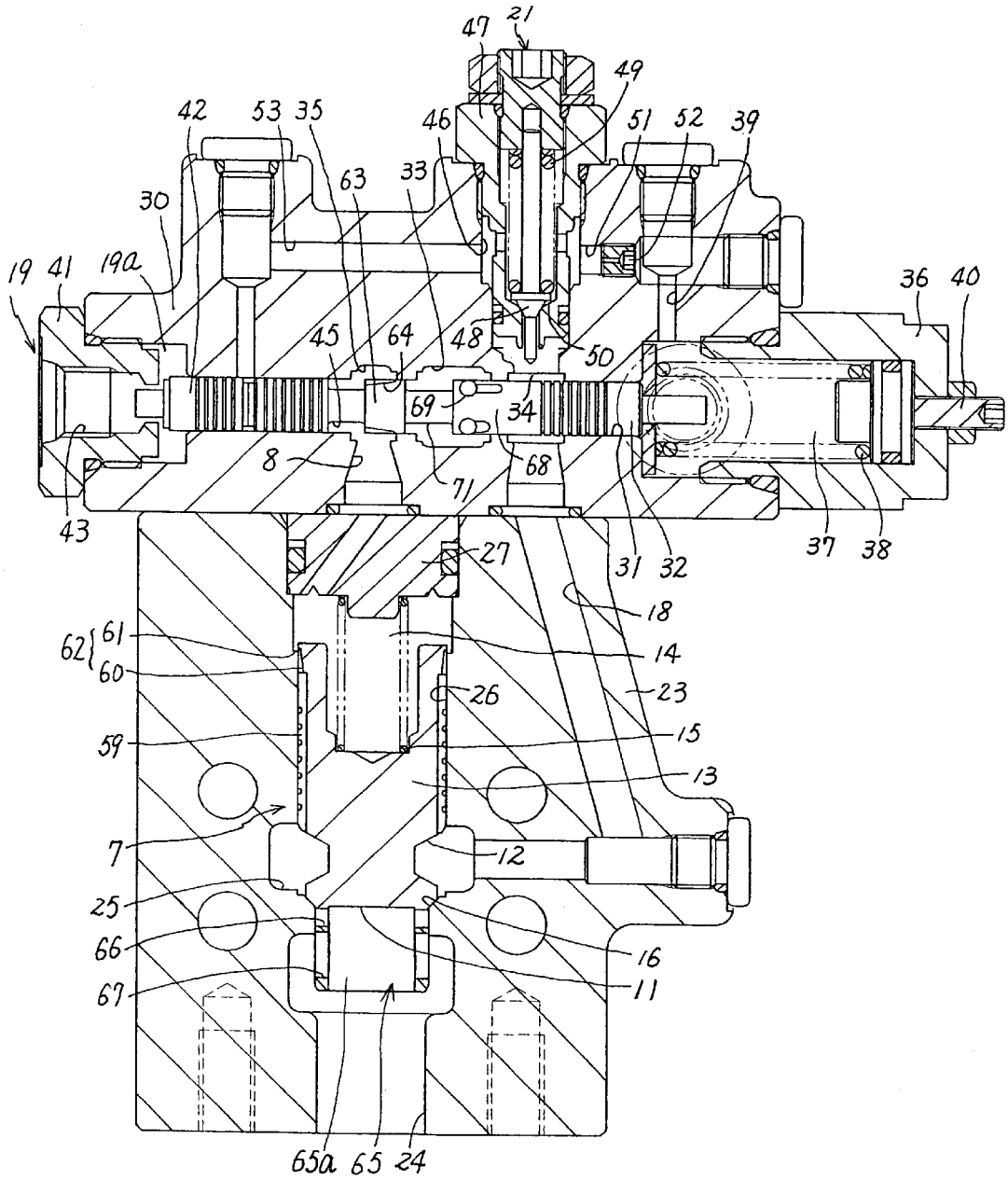
FIG. 9 is a sectional view showing a structure of a load supporting valve assembly 6 in the hydraulic control system of the sixth embodiment.

In a sixth embodiment shown in FIGS. 8 and 9, the structure of the selector valve in the second communicating position z of the fourth embodiment (see FIGS. 5 and 6) is changed. The rest of structure in this embodiment is the same as that in the fourth embodiment.

As shown in FIG. 8, in the sixth embodiment, if the selector valve 19 switches to the second communicating position z, the selector valve 19 establishes a communication between the back pressure chamber 14 of the pilot check valve 7 and the load supporting passage 5 via the throttle 58, while closing the bypass 18.

As specifically shown in FIG. 9, the second communicating position z of the selector valve 19 is designed not to establish a communication between a notch 69, formed on a land portion 68 of the spool 32, and a circular groove is 71.

After moving from a normal state toward the right side of the drawing, the above notch 69 establishes a fluid connection between the port 33 and the port 34, but if the spool 32 is further moved rightward, the communication between the port 33 and the port 34 is blocked by the land portion 68. The communication between the port 33 and the port 34 is blocked, thereupon the communication between the port 33 and the port 35 is established via the notch 64, which is shown leftward in the drawing.

Regarding operation in the sixth embodiment, the explanation will be carried out about only the operation when the selector valve 19 switches to the second communicating position z, because this is a different operation from that in the fourth embodiment.

The pilot pressure exceeding the predetermined value is introduced into the pilot chamber 19*a* of the selector valve 19 and the selector valve 19 switches to the second communicating position z, thereupon the selector valve 19 establishes a communication between the back pressure chamber 14 and the load supporting passage 5 via the throttle 58 while closing the bypass 18.

After establishing the communication between the back pressure chamber 14 and the load supporting passage 5 via the throttle 58, a differential pressure is produced before and behind variable throttle passage 57, and the pilot check valve 7 opens.

Thus, the hydraulic fluid in the bottom pressure chamber 3*a* of the cylinder device 3 is discharged via the pilot check valve 7 to the tank, and the work load W is moved down.

When the work load W is moved down as explained above, the bypass 18 is closed due to the second communicating position z of the selector valve 19, hence the following effects are obtained.

When the selector valve 19 is shifted to the second communicating position z, if the bypass 18 is still opened via throttle 20, as it is done in the first communicating position y, the hydraulic fluid from the bottom pressure chamber 3*a* would be discharged via the bypass 18 and the pilot check valve 7.

As explained hereinbefore, the degree of opening throttle 20 is larger than the degree of opening throttle 58, so that pressure loss produced when the hydraulic fluid flows in the throttle 20 acts as back pressure on the back pressure chamber 14 of the pilot check valve 7. Therefore, the pressure inside the back pressure chamber 14 becomes unstable.

Since the pressure inside the back pressure chamber 14 is a factor for deciding the degree of opening pilot check valve 7, the degree of opening pilot check valve 7 is unstable if the pressure inside the back pressure chamber 14 is unstable. Unless the degree of opening the pilot check valve 7 is stable, the flow discharged from the bottom pressure chamber 3*a* of the cylinder device 3 is not stable, resulting in a disadvantage of unstable speed for moving down the work load W.

However, insofar as the bypass 18 is closed in the second communicating position z of the selector valve 19 as described in the sixth embodiment, the pressure inside the back pressure chamber 14 is stable, resulting in no disadvantage of changing of the speed for moving down the work load W.

Figure 10:
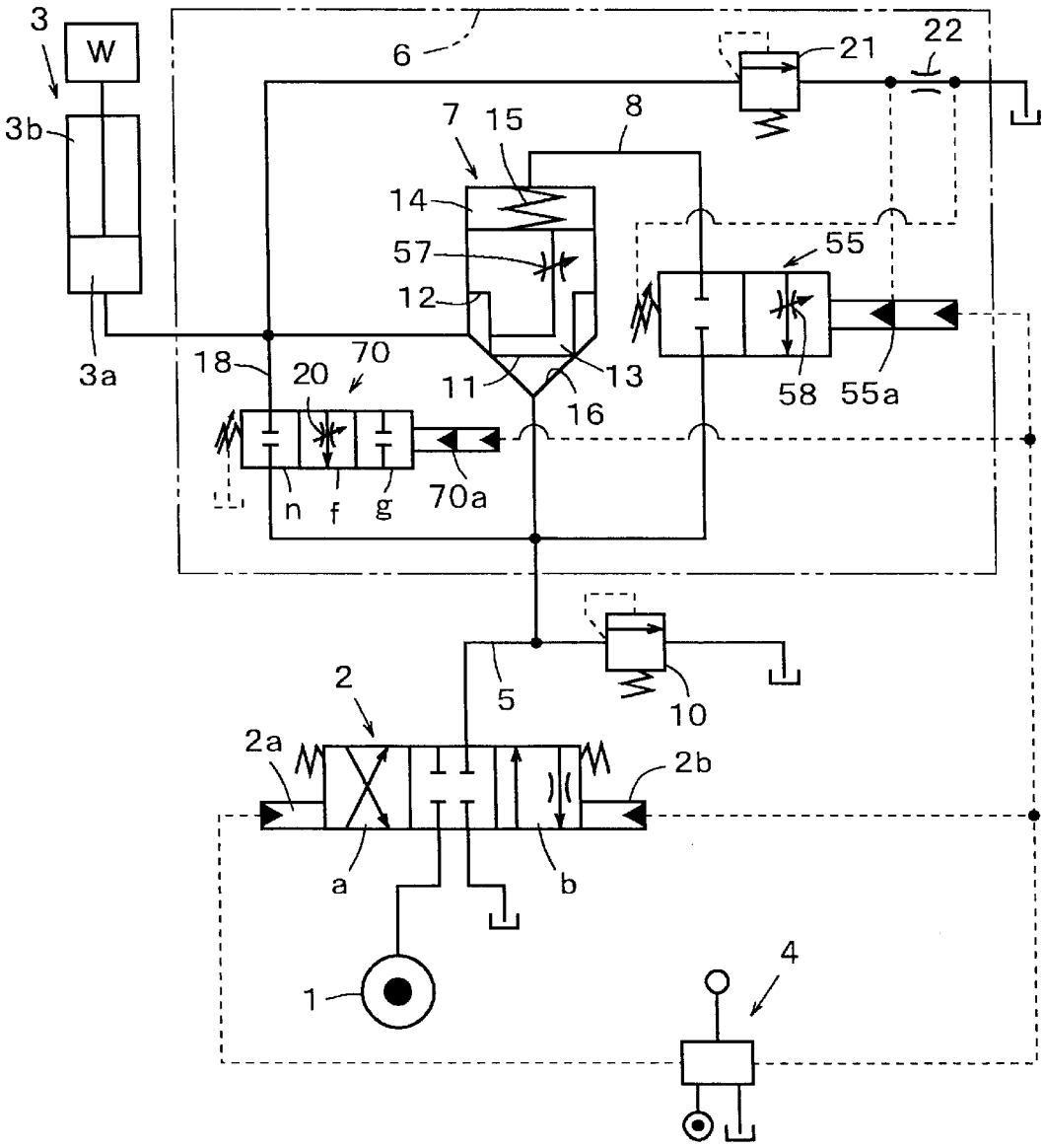
FIG. 10 is a circuit diagram of a hydraulic control system of a seventh embodiment according to the present invention.

In a seventh embodiment shown in FIG. 10, the above sixth embodiment is applied to the second embodiment (FIG. 3). More specifically, a first selector valve 70 has three positions: a normal position n for blocking a communication between the bottom pressure chamber 3*a* of the cylinder device 3 and the load supporting passage 5; a first switch position f for establishing a communication between the bottom pressure chamber 3*a* and the load supporting passage 5 via the throttle 20; and a second switch position g for blocking the communication in the first switch position f.

A pilot pressure less than the predetermined pressure is introduced a pilot chamber 70*a* of the first selector valve 70, thereupon the first selector valve 70 switches to the first switch position f, and when the pilot pressure exceeds the predetermined pressure, it switches to the second switch position The variable throttle valve 57 is provided in the pilot check valve 7, and the second selector valve 55 forms the throttle 58 at its switch position.

According to the seventh embodiment, the second selector valve 55 is in the switching state and the back pressure chamber 14 of the pilot check valve 7 and the load supporting passage 5 are connected via the throttle 58, thereupon the first selector valve 70 becomes in the second switch position g, so as to close the bypass 18.

By closing the by pass 18, when the pilot check valve 7 is opened and the hydraulic fluid in the bottom pressure chamber 3*a* of the cylinder device 3 is discharged, the pressure in the back pressure chamber 14 of the pilot check valve 7 becomes not unstable.

In consequence, similar to the sixth embodiment, a speed of moving down the work load W is not still changed in the seventh embodiment.

It should be mentioned that similar to the foregoing first and second embodiments, in the fourth embodiment through the seventh embodiment, when the selector valve 19 is in the first communicating position y, if the load supporting passage 5 is fractured or the like, the throttle 20 is position upstream from the fractured section, so that the hydraulic fluid in the bottom pressure chamber 3*a* of the cylinder device 3 is prevented from strongly escaping from the fractured section on the load supporting passage 5. As a result, the objective is prevented from rapidly dropping and damaging.

Even when an external force is applied to the supported work load W, shock produced inside the circuit is absorbed by functions of the pilot check valve 7 and overload relief valve 10.

Moreover, since the overload relief valve 10 is not required to connect to the passage between the bottom pressure chamber 3*a* of the cylinder device 3 and the pilot check valve 7, the machine can be reduced in cost and size.

According to the first invention, the control valve switches to a downward position, thereupon first and second selector means switch.

In this time, if a pilot pressure for switching the control valve to the downward position is less than a predetermined value, only the first selector means switches. If the second selector means is in a normal state and only the first selector means has switched, a flow from a pressure chamber of a cylinder device is blocked by a pilot check valve, and also a hydraulic fluid in the pressure chamber of the cylinder device is discharged from a bypass via a throttle.

In the above state, even if a load supporting passage between the control valve and the pilot check valve is fractured or the like, since the throttle is positioned upstream from the fractured section, the hydraulic fluid in the pressure chamber of the cylinder device is prevented from rapidly escaping from the fractured section. The work load, therefore, is prevented from rapidly moving down.

According to the second invention, since an opening area of the pilot check valve is gently increased, a disadvantage of producing shock when the pilot check valve is opened is avoided.

According to the third invention, since the bypass is designed to close when the pilot check valve opens, the pressure inside a back pressure chamber of the pilot check valve is not changed due to the influence of changing pressure in the bypass.

As a result, since the degree of pilot-check-valve opening is controlled to be stable, a disadvantage in which a speed of moving down the work load is changed is avoided.

According to the fourth invention, while the work load is supported, in other words, while the control valve is in a neutral position, even if an external force is applied to the work load, the pilot valve is opened and thereby the pressure chamber of the cylinder device communicates with the overload relief valve. In consequence, the overload relief valve is arranged at a position close to a construction machine body in which a tank is mounted, so that a pipe for connecting the overload relief valve with the tank is short in length, resulting in reduction in cost and size.

According to the fifth invention, when the second selector means switches, a port for connecting the control valve and a port connecting to the pressure chamber of the cylinder device are connected via small holes having a small opening area, so that if the load supporting passage between the control valve and the pilot check valve is fractured or the like in the above state, the hydraulic fluid discharged from the pressure chamber of the cylinder device is limited by the small holes.

In consequence, strongly escaping of the hydraulic fluid from the fractured section on the load supporting passage is avoided, resulting in prevention of the work load from rapidly dropping.

What is claimed is:

1. A hydraulic control system, having a pump, a cylinder device, a pressure chamber provided in the cylinder device and generating a load pressure, a control valve blocking the cylinder device from the pump in its neutral position and introducing a discharged oil from the pump into the pressure chamber of the cylinder device to move up a work load when switching to an upward position and discharging the hydraulic fluid in the pressure chamber of the cylinder device to move down the work load when switching to a downward position, pilot pressure control means for controlling the pilot pressure for switching the control valve to the upward position or the downward position, a pilot check valve arranged between the pressure chamber of the cylinder device and the control valve, and a back pressure chamber provided in the pilot check valve and receiving the load pressure in the pressure chamber of the cylinder device, the pilot check valve blocking flow from the pressure chamber of the cylinder device when the pressure in the back pressure chamber of the pilot check valve is equal to the load pressure in the pressure chamber of the cylinder device, and the pilot check valve being opened to receive the flow from the pressure chamber of the cylinder device when the hydraulic fluid in the back pressure chamber of the pilot check valve is discharged, said hydraulic control system comprising:

a bypass connecting the pressure chamber of the cylinder device with a load supporting passage between the control valve and the pilot check valve;

first selector means for blocking said bypass in its normal state, and for establishing a communication between a pressure chamber of the pilot check valve and the load supporting passage via a throttle in its switching state; and second selector means for maintaining the pressure in the back pressure chamber of the pilot check valve at the same value as the load pressure of the pressure chamber of the cylinder device in its normal state, and for discharging the hydraulic fluid in the back pressure chamber in its switching state, wherein said first and second selector means switch by the pilot pressure for switching the control valve to the downward position, and only said first selector means switches when a value of the pilot pressure is less than a predetermined value, and said second selector means as well as said first selector means switches when a value of the pilot pressure exceeds the predetermined value.

2. The hydraulic control system according to claim 1 further comprising a variable throttle, varying the degree of opening thereof in accordance with the amount of pushing-up of a valve member of the pilot check valve, on a passage between the back pressure chamber of the pilot check valve and the pressure chamber of the cylinder device.

3. The hydraulic control system according to claim 1 wherein said first selector means has a normal position for blocking a fluid connection between the pressure chamber of the cylinder device and the load supporting passage, a first switch position for establishing a fluid connection between the pressure chamber of the cylinder device and the load supporting passage via the throttle, and a second switch position for blocking the fluid connection between the pressure chamber of the cylinder device and the load supporting passage, and said first selector means switches to said first switch position when a value of the pilot pressure is less than a predetermined value, and said first selector means switches to said second switch position when a value of the pilot pressure exceeds the predetermined value.

4. The hydraulic control system according to claim 1, further comprising:

an overload relief valve connecting to the load supporting passage between the control valve and the pilot check valve;

a relief valve connecting to a passage between the pressure chamber of the cylinder device and the pilot check valve; and an orifice arranged downstream from the relief valve, wherein said second selector means switches by the pressure produced in the upstream of said orifice when said relief valve opens.

5. The hydraulic control system according to claim 1, wherein the pilot check valve is structured by incorporating the valve member into a sliding hole formed in a body, and an end of the valve member connects with a port for connecting with the control valve, and a nose portion having an internal passage is provided at the end of the valve member and has small holes, having a small opening area and opening toward the internal passage, in the proximal end thereof, the port connecting with the control valve and a port connecting with the pressure chamber of the cylinder device being connected via said small holes when said second selector means switches.

* * * * *